US010291000B2

(12) United States Patent
Sugiura et al.

(10) Patent No.: US 10,291,000 B2
(45) Date of Patent: May 14, 2019

(54) IGNITION APPARATUS

(71) Applicant: DENSO CORPORATION, Kariya, Aichi-pref. (JP)

(72) Inventors: Akimitsu Sugiura, Kariya (JP); Kenji Hattori, Kariya (JP); Shunichi Takeda, Kariya (JP); Kaori Doi, Kariya (JP); Ryota Wakasugi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/743,732

(22) PCT Filed: Jul. 5, 2016

(86) PCT No.: PCT/JP2016/069862
§ 371 (c)(1),
(2) Date: Jan. 11, 2018

(87) PCT Pub. No.: WO2017/010341
PCT Pub. Date: Jan. 19, 2017

(65) Prior Publication Data

US 2018/0205204 A1 Jul. 19, 2018

(30) Foreign Application Priority Data

Jul. 13, 2015 (JP) ..... 2015-139755

(51) Int. Cl.
*F02P 3/00* (2006.01)
*H01T 13/00* (2006.01)
(Continued)

(52) U.S. Cl.
CPC ..... *H01T 15/00* (2013.01); *F02P 3/04* (2013.01); *F02P 13/00* (2013.01); *F02P 15/00* (2013.01);
(Continued)

(58) Field of Classification Search
CPC ..... H01T 15/00; H01T 13/04; H01T 13/08; H01T 13/20; H01T 13/38; H01T 13/42;
(Continued)

(56) References Cited

U.S. PATENT DOCUMENTS 4,617,907 A * 10/1986 Johansson ..... H01T 13/04 123/634
4,621,881 A * 11/1986 Johansson ..... H01T 13/04 174/138 S
(Continued)

FOREIGN PATENT DOCUMENTS

| | | |
|---|---|---|
| GB | 2 328 324 B | 2/1999 |
| JP | 63-116414 | 5/1988 |
| JP | 2002-266737 | 9/2002 |

*Primary Examiner* — Thomas Moulis
(74) *Attorney, Agent, or Firm* — Nixon & Vanderhye P.C.

(57) ABSTRACT

An ignition apparatus includes a spark plug and an ignition coil. The spark plug has a plug terminal protruding proximalward from an insulator. The ignition coil includes a coil main body, which includes a primary coil and a secondary coil, and a helical spring that electrically connects the secondary coil and the plug terminal. The plug terminal is made of a material that is both electrically conductive and magnetic. The plug terminal includes a terminal main body, which has an outer diameter greater than an inner diameter of the spring, and a terminal extension portion that has an outer diameter less than the inner diameter of the spring and extends proximalward from the terminal main body. A distal end portion of the spring abuts the terminal main body. The terminal extension portion is inserted and arranged in the spring. Between an outer circumferential surface of the terminal extension portion and an inner circumferential surface of the spring, there is interposed an insulating member.

4 Claims, 8 Drawing Sheets

(51) Int. Cl.

| | |
|---|---|
| ***H01T 15/00*** | (2006.01) |
| ***F02P 13/00*** | (2006.01) |
| ***F02P 15/00*** | (2006.01) |
| ***H01T 13/20*** | (2006.01) |
| ***F02P 3/04*** | (2006.01) |
| ***H01F 38/12*** | (2006.01) |
| ***H01T 13/08*** | (2006.01) |
| ***H01T 13/38*** | (2006.01) |
| ***H01T 13/04*** | (2006.01) |
| ***H01T 13/42*** | (2006.01) |
| *H01T 13/32* | (2006.01) |
| *F02P 3/02* | (2006.01) |

(52) U.S. Cl.
CPC ..... *H01F 38/12* (2013.01); *H01T 13/04* (2013.01); *H01T 13/08* (2013.01); *H01T 13/20* (2013.01); *H01T 13/38* (2013.01); *H01T 13/42* (2013.01); *F02P 3/02* (2013.01); *H01T 13/32* (2013.01)

(58) Field of Classification Search
CPC .. H01T 13/32; H01F 38/12; F02P 3/02; F02P 3/04; F02P 13/00; F02P 15/00
See application file for complete search history.

(56) References Cited

U.S. PATENT DOCUMENTS

| | | | | |
|---|---|---|---|---|
| 5,357,233 | A * | 10/1994 | Wada | H01F 38/12 123/634 |
| 5,890,473 | A * | 4/1999 | Hammer | H01T 13/06 123/143 C |
| 6,363,898 | B1 * | 4/2002 | Ripma | H01T 13/08 123/142.5 E |
| 2002/0014939 | A1 * | 2/2002 | Martagni | H01T 13/05 336/90 |
| 2003/0197584 | A1 * | 10/2003 | Ford | H01F 27/29 336/96 |
| 2006/0061446 | A1 * | 3/2006 | Kato | F02P 3/02 336/90 |
| 2008/0024258 | A1 * | 1/2008 | Nakao | H01F 38/12 336/107 |
| 2012/0307413 | A1 | 12/2012 | Masuzawa | |
| 2014/0328002 | A1 | 11/2014 | Silva et al. | |
| 2016/0115935 | A1 * | 4/2016 | Tada | F02P 3/04 315/209 T |
| 2016/0211072 | A1 * | 7/2016 | Kawai | H01F 38/12 |
| 2017/0016422 | A1 * | 1/2017 | Akimoto | F02P 3/055 |
| 2017/0152829 | A1 * | 6/2017 | Ikeda | F02P 3/01 |
| 2017/0321648 | A1 * | 11/2017 | Sano | H01F 38/12 |
| 2018/0030947 | A1 * | 2/2018 | Anderson | F02F 1/00 |
| 2018/0108473 | A1 * | 4/2018 | Akimoto | H01F 38/12 |
| 2018/0294092 | A1 * | 10/2018 | Sato | H01F 38/12 |
| 2018/0309268 | A1 * | 10/2018 | Idogawa | H01T 13/04 |
| 2018/0316161 | A1 * | 11/2018 | Notarfrancesco | H01T 13/04 |
| 2018/0342347 | A1 * | 11/2018 | Ide | F02P 15/00 |

* cited by examiner

IGNITION APPARATUS

This application is the U.S. national phase of International Application No. PCT/JP2016/069862 filed Jul. 5, 2016 which designated the U.S. and claims priority to JP Patent Application No. 2015-139755 filed Jul. 13, 2015, the entire contents of each of which are hereby incorporated by reference.

TECHNICAL FIELD

The present invention relates to ignition apparatuses for internal combustion engines.

BACKGROUND ART

As ignition apparatuses for internal combustion engines, there are known those which include a spark plug to be used as an ignition means for an internal combustion engine and an ignition coil that applies a high voltage to the spark plug.

In an ignition apparatus disclosed in Patent Document 1, inductance is formed in a spring that electrically connects between a secondary coil of the ignition coil and the spark plug. Specifically, inductance is formed by increasing the number of turns or the like at a part of the spring. Consequently, it is possible to reduce noise, which is generated during a discharge of the spark plug, without increasing the parts count of the ignition apparatus.

PRIOR ART LITERATURE

Patent Literature

[PATENT DOCUMENT 1] Japanese Patent Application Publication No. JP2002266737A

SUMMARY OF THE INVENTION

Problems to be Solved by the Invention

However, there is a limit in the inductance that can be secured by increasing the number of turns of a part of the spring or the like. Therefore, it is difficult to sufficiently improve the impedance to the noise; thus, there are cases where it is difficult to achieve a reduction in the noise.

The present invention has been made in view of the above problems, and aims to provide an ignition apparatus capable of effectively reducing the noise.

Means for Solving the Problems

An ignition apparatus according to the present invention includes:

a spark plug to be used as an ignition means for an internal combustion engine; and an ignition coil that applies a high voltage to the spark plug, wherein the spark plug has a plug terminal electrically connected with a center electrode and protruding proximalward from an insulator, the ignition coil includes a coil main body, which includes a primary coil and a secondary coil, and a helical spring that electrically connects the secondary coil and the plug terminal, the plug terminal is made of a material that is both electrically conductive and magnetic, the plug terminal includes a terminal main body, which has an outer diameter greater than an inner diameter of the spring, and a terminal extension portion that has an outer diameter less than the inner diameter of the spring and extends proximalward from the terminal main body, a distal end portion of the spring abuts the terminal main body, the terminal extension portion is inserted and arranged in the spring, and between an outer circumferential surface of the terminal extension portion and an inner circumferential surface of the spring, there is interposed an insulating member.

Advantageous Effects of the Invention

In the above ignition apparatus, the terminal extension portion provided in the plug terminal is inserted in the spring. That is, the terminal extension portion made of the magnetic material is arranged in the spring, thereby increasing the inductance component of the spring. Moreover, between the outer circumferential surface of the terminal extension portion and the inner circumferential surface of the spring, there is interposed the insulating member. Consequently, it is possible to prevent a reduction in impedance due to a short circuit of the spring to the electrically-conductive terminal extension portion. As a result, it is possible to improve the impedance to noise current, thereby effectively reducing the noise.

As described above, according to the present invention, it is possible to provide an ignition apparatus capable of effectively reducing the noise.

EMBODIMENTS FOR CARRYING OUT THE INVENTION

First Embodiment

An ignition apparatus 1 according to a first embodiment will be described with reference to FIGS. 1-5.

Figure 1:
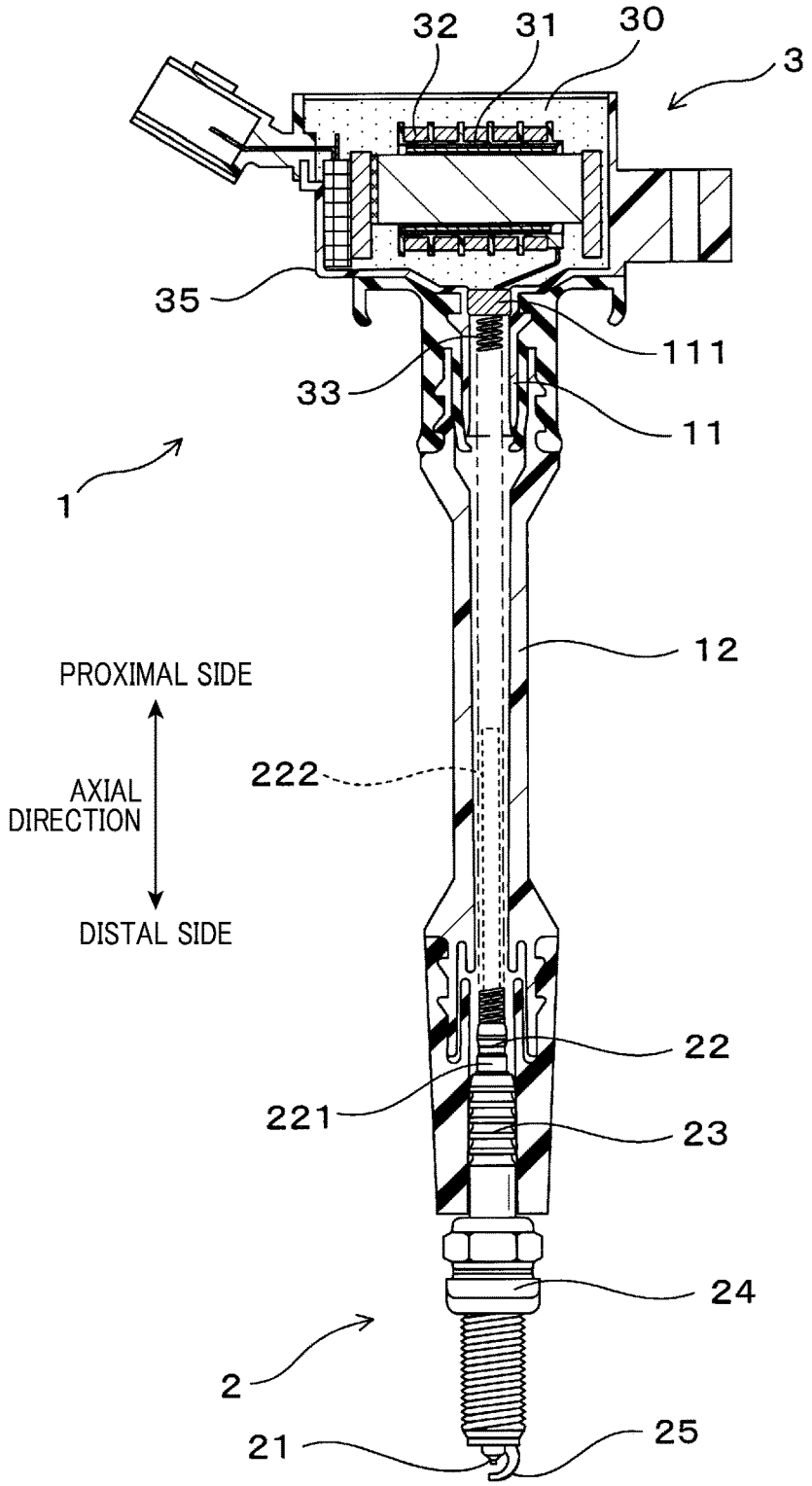
FIG. 1 is a partially cross-sectional view showing part of an ignition apparatus according to a first embodiment.

As shown in FIG. 1, the ignition apparatus 1 includes a spark plug 2 to be used as an ignition means for an internal combustion engine and an ignition coil 3 that applies a high voltage to the spark plug 2.

Figure 3:
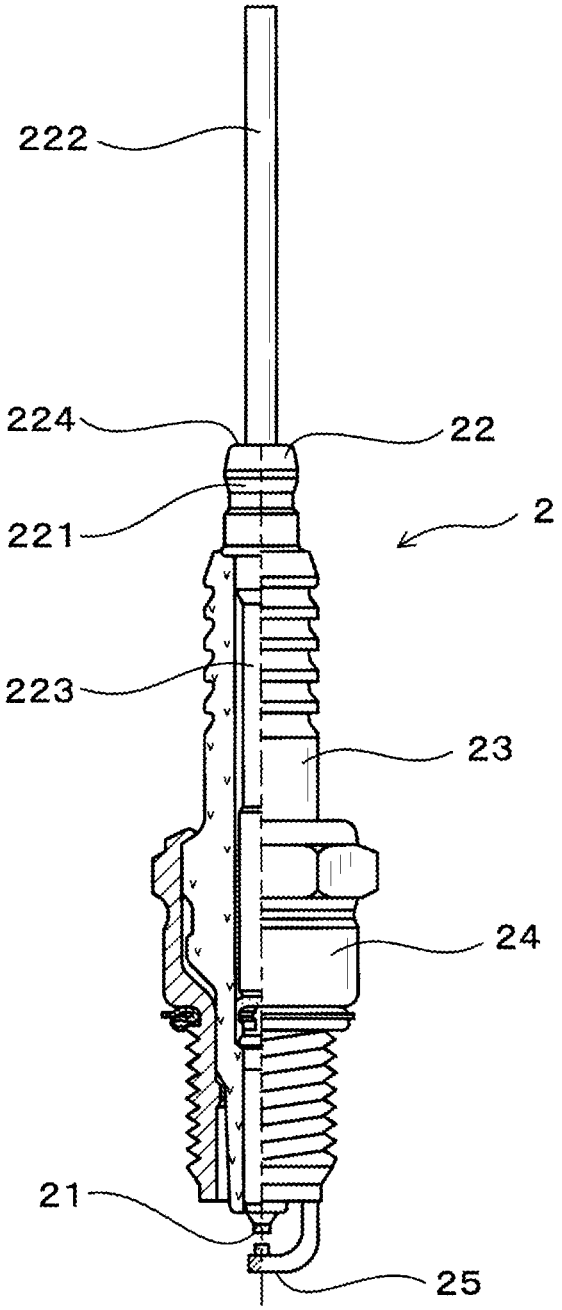
FIG. 3 is a front view in partial cross section showing the spark plug of the ignition apparatus according to the first embodiment.

As shown in FIG. 3, the spark plug 2 has a plug terminal 22 electrically connected with a center electrode 21 and protruding proximalward from an insulator 23.

As shown in FIG. 1, the ignition coil 3 includes a coil main body 30, which includes a primary coil 31 and a secondary coil 32, and a helical spring 33 that electrically connects the secondary coil 32 and the plug terminal 22.

The plug terminal 22 is made of a material that is both electrically conductive and magnetic. As shown in FIGS. 1-5, the plug terminal 22 includes a terminal main body 221, which has an outer diameter greater than an inner diameter of the spring 33, and a terminal extension portion 222 that has an outer diameter less than the inner diameter of the spring 33 and extends proximalward from the terminal main body 221.

Figure 4:
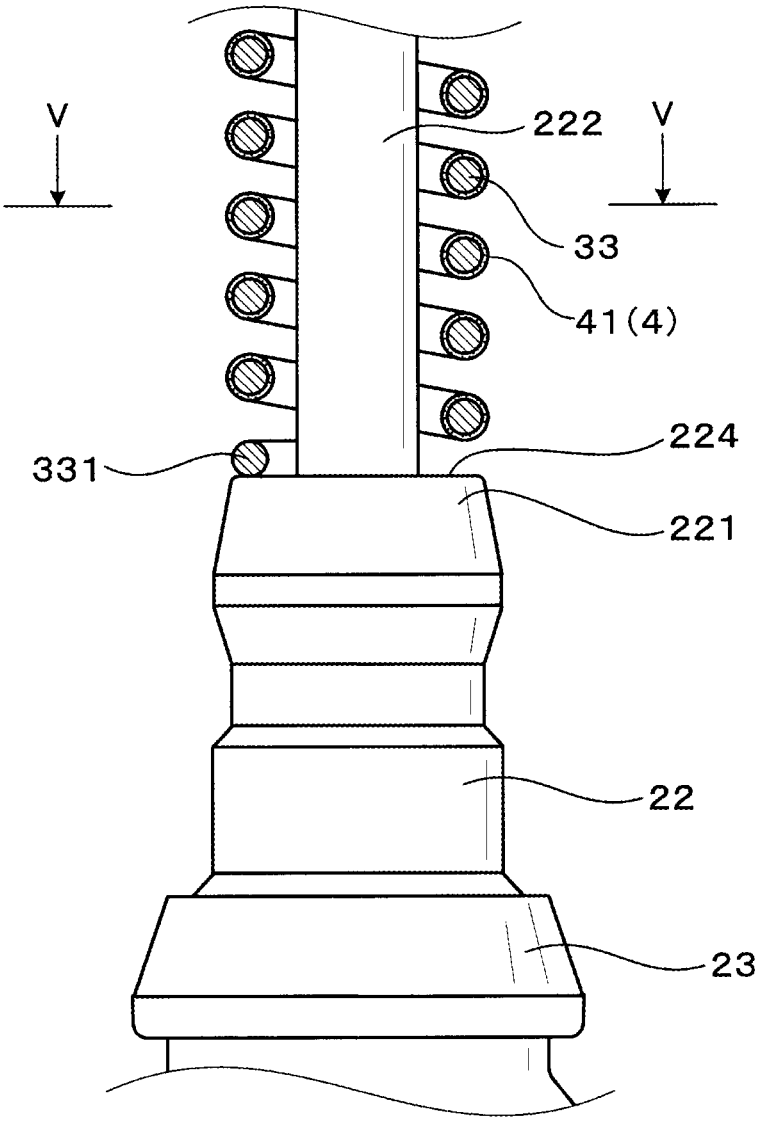
FIG. 4 is a front view in partial cross section showing the spring and a plug terminal of the ignition apparatus according to the first embodiment.

As shown in FIG. 4, a distal end portion 331 of the spring 33 abuts the terminal main body 221.

The terminal extension portion 222 is inserted and arranged in the spring 33. Between an outer circumferential surface of the terminal extension portion 222 and an inner circumferential surface of the spring 33, there is interposed an insulating member 4.

The ignition apparatus 1 is to be provided in, for example, an internal combustion engine of a motor vehicle or the like.

As shown in FIG. 1, the ignition coil 3 includes a tubular joint 12 that connects the coil main body 30 and the spark plug 2. The joint 12 is to be inserted in a plug hole (not shown) of the internal combustion engine to which the spark plug 2 is to be mounted. In the present description, explanation is made referring to the side of the spark plug 2 in an axial direction of the joint 12 as the distal side and the opposite side as the proximal side.

The coil main body 30 is formed by receiving the primary coil 31 and the secondary coil 32 in a case 35. From the case 35, a high-voltage tower portion 11 protrudes distalward. To the high-voltage tower portion 11, there is connected a proximal end portion of the joint 12. A distal end portion of the joint 12 is fitted to the spark plug 2.

The high-voltage tower portion 11 holds therein a high-voltage output terminal 111 for outputting the high voltage generated in the coil main body 30. Moreover, inside the joint 12, there is arranged the spring 33. The spring 33 has its proximal end abutting the high-voltage output terminal 111 and its distal end abutting the plug terminal 22 of the spark plug 2. That is, the spring 33 is interposed between the high-voltage output terminal 111 and the plug terminal 22 to electrically connect the high-voltage output terminal 111 and the plug terminal 22.

As shown in FIG. 3, the spark plug 2 has the insulator 23 holding the center electrode 21 therein and a housing 24 holding the insulator 23 therein. To a distal end portion of the housing 24, there is joined a ground electrode 25 that forms a discharge gap between it and the center electrode 21. Moreover, the plug terminal 22 is held in the insulator 23 and protrudes proximalward from the insulator 23.

Figure 5:
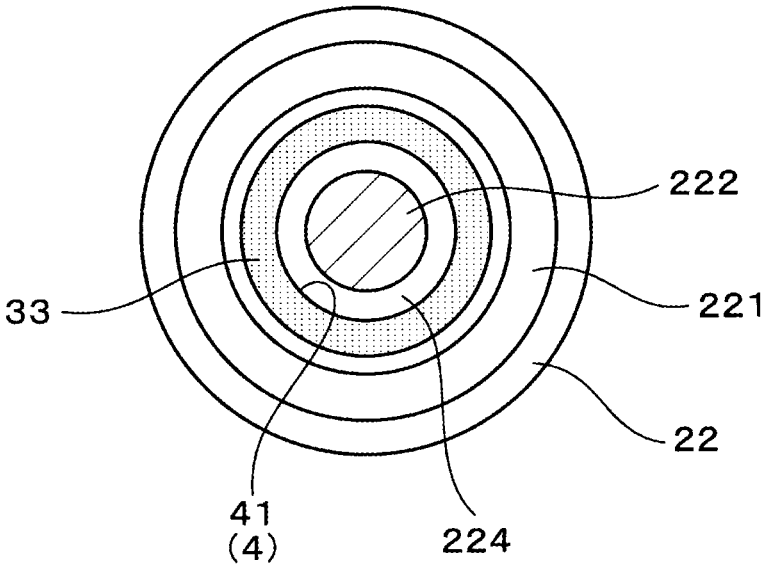
FIG. 5 is a cross-sectional view taken along lines V-V in FIG. 4.

The terminal plug 22 is made, for example, of carbon steel. As shown in FIGS. 3-5, the terminal plug 22 has the terminal main body 221 and the terminal extension portion 222 formed integrally into one piece. Moreover, a distal protruding portion 223, which protrudes distalward from the terminal main body 221, is also formed integrally with the terminal main body 221 and the terminal extension portion 222 into one piece. The terminal plug 22 has the distal protruding portion 223 fitted in the insulator 23 and the terminal main body 221 and the terminal extension portion 222 protruding proximalward from the insulator 23.

The terminal main body 221 and the terminal extension portion 222 have respective substantially cylindrical shapes with outer diameters different from each other. The terminal main body 221 and the terminal extension portion 222 are in a state where their central axes coincide with each other. The terminal main body 221 has a shape such that its outer diameter varies depending on the axial position; at least the maximum outer diameter of the terminal main body 221 is greater than the inner diameter of the spring 33. In the present embodiment, a proximal end surface 224 of the terminal main body 221 is formed as a substantially flat surface; the proximal end surface 224 has an outer diameter greater than the inner diameter of the spring 33.

On the other hand, the outer diameter of the terminal extension portion 222 is less than the inner diameter of the spring 33. The terminal extension portion 222 has such a shape as to extend straight proximalward in the axial direction from the terminal main body 221. The axial length of the terminal extension portion 222 is set according to a desired inductance. For example, it is preferable for the axial length of the terminal extension portion 222 to be greater than or equal to 10 mm. In the present embodiment, the axial length of the terminal extension portion 222 is greater than the axial length of the terminal main body 221. Moreover, the axial length of the terminal extension portion 222 is also greater than the axial length of that portion of the insulator 23 which protrudes proximalward from the housing 24. In addition, the axial length of the terminal extension portion 222 is less than the axial length of the spring 33.

Figure 2:
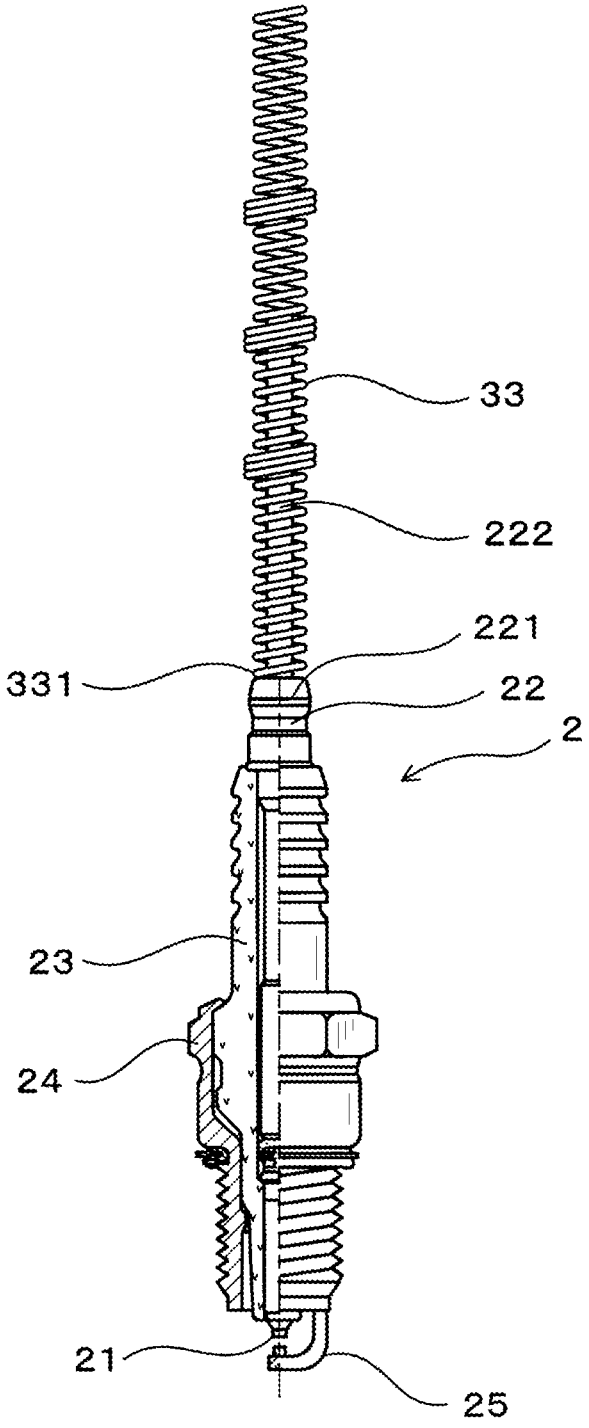
FIG. 2 is a front view in partial cross section showing a spring and a spark plug of the ignition apparatus according to the first embodiment.

In a state where the joint 12 of the ignition coil 3 and the spark plug 2 are connected, as shown in FIGS. 1 and 2, the terminal extension portion 222 of the plug terminal 22 is inserted in the spring 33 from the proximal end of the spring 33. Consequently, a magnetic body is arranged in the spring 33, thereby increasing inductance in the spring 33. That is, inductance is increased in the electric current path between the coil main body 30 of the ignition coil 3 and the spark plug 2.

The spring 33 has its distal end abutting and thereby being electrically connected with the plug terminal 22. However, it is necessary for the spring 33 to be not electrically connected with the plug terminal 22 except at the distal end portion thereof. If the spring 33 was in contact with the terminal extension portion 222 at a portion thereof other than the distal end portion, a short circuit would be formed between the contact portion and the distal end portion in the spring 33; consequently, the inductance might be lowered. Therefore, between the outer circumferential surface of the terminal extension portion 222 and the inner circumferential surface of the spring 33, there is interposed the insulating member 4.

As shown in FIG. 4, in the present embodiment, the insulating member 4 is constituted of an insulating coat 41 that is coated on the spring 33. The insulating coat 41 is formed, for example, of resin, such as polyester, nylon, polyimide, urethane or the like. The insulating coat 41 is formed over the entire circumference of the surface of winding of the spring 33. However, the distal end portion 331 of the spring 33 is exposed from the insulating coat 41; the exposed portion is placed in contact with the terminal main body 221 of the plug terminal 22. In addition, the distal end portion 331 of the spring 33 exposed from the insulating coat 41 may also be placed in contact with the terminal extension portion 222.

Next, operational effects of the present embodiment will be described.

In the above-described ignition apparatus 1, the terminal extension portion 222 provided in the plug terminal 22 is inserted in the spring 33. That is, the terminal extension portion 222 made of the magnetic material is arranged in the spring 33, thereby increasing the inductance component of the spring 33.

Moreover, between the outer circumferential surface of the terminal extension portion 222 and the inner circumferential surface of the spring 33, there is interposed the insulating member 4. Consequently, it is possible to prevent a reduction in impedance due to a short circuit of the spring 33 to the electrically-conductive terminal extension portion 222. As a result, it is possible to improve the impedance to noise current, thereby effectively reducing the noise.

Moreover, as the insulating member 4, the insulating coat 41 coated on the spring 33 is employed. Consequently, it is possible to easily and reliably insulate between the outer circumferential surface of the terminal extension portion 222 and the inner circumferential surface of the spring 33.

Moreover, since inductance can be formed with part of the plug terminal 22 and the spring 33, it is possible to effectively reduce the noise without increasing the parts count of the ignition apparatus 1. That is, it becomes unnecessary to additionally incorporate a resistor for suppressing the noise into the electric current path between the coil main body 30 and the spark plug 2. In addition, even if such a resistor was incorporated, the formation of inductance with part of the plug terminal 22 and the spring 33 would still provide advantages, such as making it possible to downsize the resistor.

As described above, according to the present embodiment, it is possible to provide an ignition apparatus capable of effectively reducing the noise.

Second Embodiment

Figure 6:
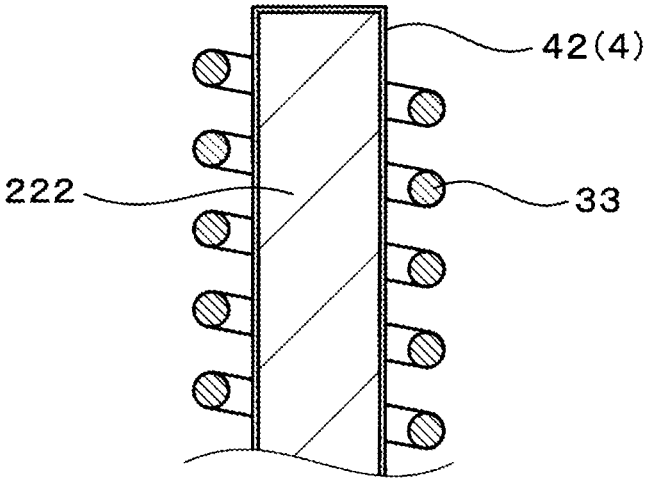
FIG. 6 is an enlarged cross-sectional view showing a terminal extension portion and components surrounding it in an ignition apparatus according to a second embodiment.

In an ignition apparatus 1 according to the present embodiment, as shown in FIG. 6, the insulating member 4, which insulates between the outer circumferential surface of the terminal extension portion 222 and the inner circumferential surface of the spring 33, is constituted of an insulating coat 42 that is coated on the terminal extension portion 222. Specifically, the insulating coat 42 is formed by applying, on the outer surface of the terminal extension portion 222, resin such as epoxy, unsaturated polyester, silicone, fluororesin or the like. Moreover, in the present embodiment, unlike in the first embodiment, no insulating coat 41 is coated on the spring 33.

In the present embodiment, the insulating coat 42 covers a proximal end surface of the terminal extension portion 222 as well as the outer circumferential surface of the terminal extension portion 222. In addition, the insulating coat 42 may be not formed on the proximal end surface of the terminal extension portion 222, provided that the insulating coat 42 can insulate between the outer circumferential surface of the terminal extension portion 222 and the inner circumferential surface of the spring 33.

The others are the same as in the first embodiment. In addition, from the second embodiment on, unless specified otherwise, elements having reference signs identical to those used hitherto are identical to the elements having the identical reference signs in the previous embodiment.

In the present embodiment, the insulating coat 42 is coated on the outer circumferential surface of the terminal extension portion 222. In this case, it is also possible to easily and reliably insulate between the outer circumferential surface of the terminal extension portion 222 and the inner circumferential surface of the spring 33. Besides, it is also possible to achieve the same advantageous effects as in the first embodiment.

Third Embodiment

Figure 7:
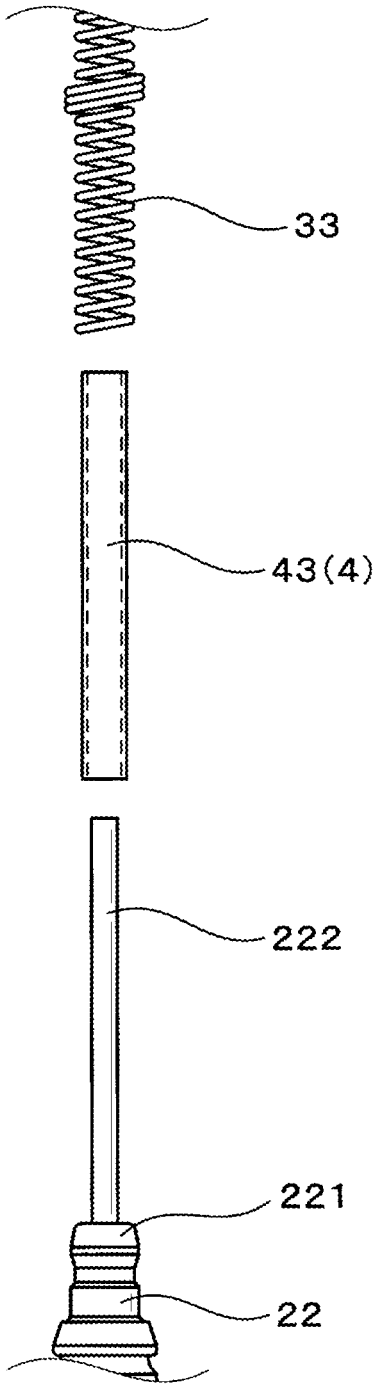
FIG. 7 is an exploded side view showing a terminal extension portion and components surrounding it in an ignition apparatus according to a third embodiment.
Figure 8:
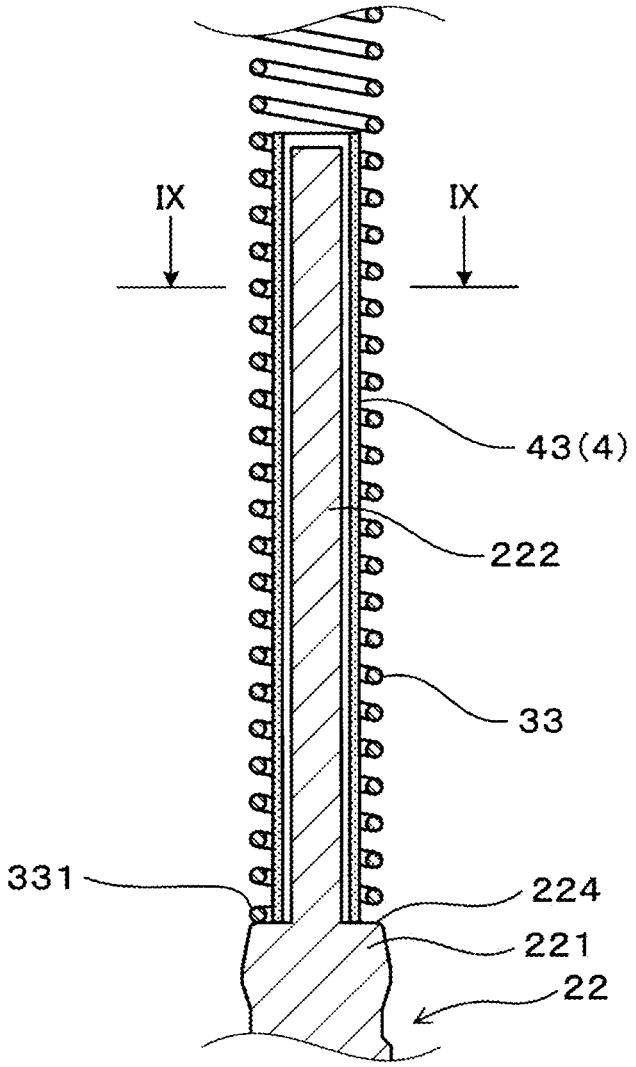
FIG. 8 is an enlarged cross-sectional view showing the terminal extension portion and the components surrounding it in the ignition apparatus according to the third embodiment.
Figure 9:
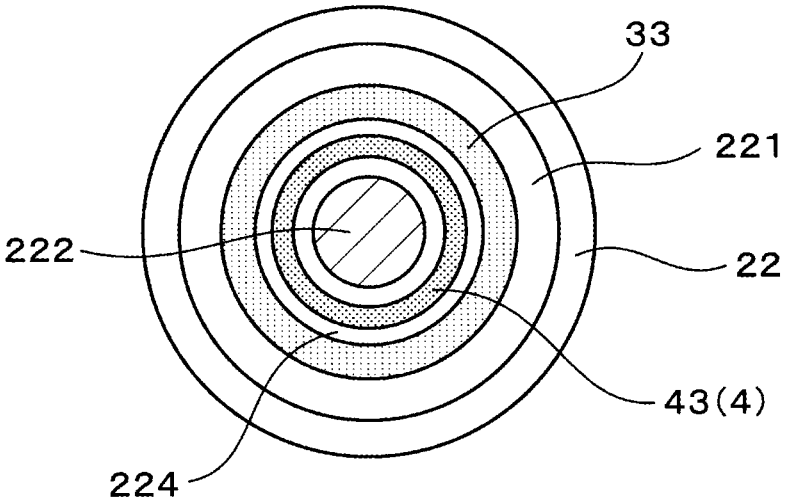
FIG. 9 is a cross-sectional view taken along lines IX-IX in FIG. 8.

In an ignition apparatus 1 according to the present embodiment, as shown in FIGS. 7-9, the insulating member 4 is constituted of an insulating spacer 43 that is arranged between the outer circumferential surface of the terminal extension portion 222 and the inner circumferential surface of the spring 33.

The insulating spacer 43 is formed, for example of resin such as polyolefin, polyester or the like, into a thin cylindrical shape. As shown in FIGS. 8 and 9, the inner diameter of the thin cylindrical insulating spacer 43 is greater than the outer diameter of the terminal extension portion 222. Moreover, the outer diameter of the insulating spacer 43 is less than the inner diameter of the spring 33.

As shown in FIG. 8, the insulating spacer 43 has its distal end abutting the proximal end surface 224 of the terminal main body 221. Moreover, it is preferable for the insulating spacer 43 to have an axial length greater than or equal to the axial length of the terminal extension portion 222. In the present embodiment, the axial length of the insulating spacer 43 is slightly greater than the axial length of the terminal extension portion 222. However, the axial length of the insulating spacer 43 is not particularly limited.

Moreover, in the present embodiment, unlike in the first embodiment, no insulating coat 41 is coated on the spring 33.

The others are the same as in the first embodiment.

In the present embodiment, between the outer circumferential surface of the terminal extension portion 222 and the inner circumferential surface of the spring 33, there is interposed the insulating spacer 43 as the insulating member 41. Consequently, it becomes unnecessary to coat the insulating coat 41 or 42 on either the spring 33 or the terminal extension portion 222. Besides, it is also possible to achieve the same advantageous effects as in the first embodiment.

The present invention is not limited to the above-described embodiments and can be carried out in various modes without departing from the spirit of the invention. For example, the first to the third embodiments may be suitably combined. Moreover, in the third embodiment, the shape of the insulating spacer 43 may be suitably modified. Specifically, it is only necessary for the insulating spacer to be configured to be capable of securing insulation between the outer circumferential surface of the terminal extension portion and the inner circumferential surface of the spring. For example, the insulating spacer may be provided over only part of the entire circumferential range. That is, the insulating spacer may be configured to have a substantially C-shaped cross section perpendicular to the axial direction. Moreover, in the above-described embodiments, the insulating member (the insulating coat 41 or 42 or the insulating spacer 43) is formed of resin. However, the insulating member may alternatively be formed of other electrically-insulative materials, such as a ceramic.

DESCRIPTION OF REFERENCE SIGNS

1: ignition apparatus
2: spark plug
21: center electrode

22: plug terminal
221: terminal main body
222: terminal extension portion
3: ignition coil
30: coil main body
31: primary coil
32: secondary coil
33: spring
4: insulating member

The invention claimed is:

1. An ignition apparatus comprising:

a spark plug to be used as an ignition means for an internal combustion engine; and an ignition coil that applies a high voltage to the spark plug, wherein the spark plug has a plug terminal electrically connected with a center electrode and protruding proximalward from an insulator, the ignition coil includes a coil main body, which includes a primary coil and a secondary coil, and a helical spring that electrically connects the secondary coil and the plug terminal, the plug terminal is made of a material that is both electrically conductive and magnetic, the plug terminal includes a terminal main body, which has an outer diameter greater than an inner diameter of the spring, and a terminal extension portion that has an outer diameter less than the inner diameter of the spring and extends proximalward from the terminal main body, a distal end portion of the spring abuts the terminal main body, the terminal extension portion is inserted and arranged in the spring, and between an outer circumferential surface of the terminal extension portion and an inner circumferential surface of the spring, there is interposed an insulating member.

2. The ignition apparatus as set forth in claim 1, wherein the insulating member is constituted of an insulating coat that is coated on the spring.

3. The ignition apparatus as set forth in claim 1, wherein the insulating member is constituted of an insulating coat that is coated on the terminal extension portion.

4. The ignition apparatus as set forth in claim 1, wherein the insulating member is constituted of an insulating spacer that is arranged between the outer circumferential surface of the terminal extension portion and the inner circumferential surface of the spring.

* * * * *